US007753040B2

(12) United States Patent
Victor et al.

(10) Patent No.: US 7,753,040 B2
(45) Date of Patent: Jul. 13, 2010

(54) HELICAL FIELD ACCELERATOR

(76) Inventors: Michael Victor, 45-18 39th Pl., Basement, Sunnyside, NY (US) 11104; Robert Victor, 45-18 39th Pl., Basement, Sunnyside, NY (US) 11104

( * ) Notice: Subject to any disclaimer, the term of this patent is extended or adjusted under 35 U.S.C. 154(b) by 912 days.

(21) Appl. No.: 10/972,661

(22) Filed: Oct. 25, 2004

(65) Prior Publication Data

US 2009/0314269 A1 Dec. 24, 2009

Related U.S. Application Data

(60) Provisional application No. 60/514,487, filed on Oct. 24, 2003.

(51) Int. Cl.
*F41F 7/00* (2006.01)

(52) U.S. Cl. ..... 124/3; 124/6; 124/10

(58) Field of Classification Search ..... 124/3, 124/6, 10

See application file for complete search history.

(56) References Cited

U.S. PATENT DOCUMENTS 2,700,839 A * 2/1955 Finlay et al. ..... 42/79
3,535,057 A * 10/1970 Kodra ..... 418/1
4,447,975 A * 5/1984 Ljutic ..... 42/16
5,054,464 A * 10/1991 Young ..... 124/72
5,549,461 A * 8/1996 Newland ..... 417/477.11
5,688,112 A * 11/1997 Garay ..... 417/477.1
5,819,715 A * 10/1998 Haneda et al. ..... 124/6
5,851,361 A * 12/1998 Hogan ..... 202/136
6,270,326 B1 * 8/2001 Kuriyama ..... 417/477.4
6,447,276 B1 * 9/2002 Becher ..... 418/201.3
6,655,934 B2 * 12/2003 Mittelstein et al. ..... 417/477.9
6,702,558 B2 3/2004 Becher
6,719,547 B2 * 4/2004 Heizer ..... 418/201.1
6,773,243 B2 * 8/2004 Becher ..... 418/191

* cited by examiner

*Primary Examiner*—Michael Carone
*Assistant Examiner*—Gabriel J Klein
(74) *Attorney, Agent, or Firm*—Peter J. Rashid

(57) ABSTRACT

A helical field device that accelerates an object to high velocity by converting rotational kinetic energy in the device into linear kinetic energy in the object, and alternatively, that decelerates objects from high velocity by converting the linear kinetic energy in the object into rotational kinetic energy in the device. The device transfers kinetic energy between the device and an object through the use of a localized high pressure field in the form of a helix having a variable pitch along the length of the device, which couples the object to the device without the pressure field itself significantly contributing energy into the system. Instead, the energy that is used to accelerate the object comes from the kinetic energy imparted to the device by an outside source, such as an engine, or a potential energy storage device.

19 Claims, 9 Drawing Sheets

HELICAL FIELD ACCELERATOR

This application claims the benefit of U.S. Provisional Application No. 60/514,487, filed Oct. 24, 2003, the entire contents of which are herein incorporated by reference.

BACKGROUND OF THE INVENTION

1. Field of the Invention

The invention relates in general to a device that accelerates an object or a fluid, and in particular to a device that accelerates an object to high velocity by a helical force field that converts rotational kinetic energy in the device into linear kinetic energy in the object or fluid, and alternatively, that decelerates an object or a fluid from high velocity to low velocity by converting the linear kinetic energy into rotational kinetic energy.

2. Description of the Related Art

There are many different types of accelerating devices. For example, a railgun is a device in which electrical current is made to flow cross-wise through a conductive projectile, causing the projectile to become magnetized. Because magnetic fields and electrical current are repelled by each other, and because this repulsive force always acts in a direction perpendicular to the flow of the electrical current, the projectile is made to accelerate forward in response to this current flow.

Because railguns are powered by electricity, they require heavy and complex systems to store this electrical energy, and to produce and condition their huge electrical power pulses. For example, the University of Texas Center for Electromagnetics is creating an experimental rail gun for the US Marines that will accelerate a 2 kg projectile to 2.5 km/s. The railgun requires a power system that produces a 30 GigaWatt electrical pulse, stores hundreds of megajoules of energy, and weighs many tens of tons.

Railguns operate at extreme current densities. As a comparison, a resistance welder, which uses electrical current to melt and weld material, operates at a fraction of the current density of typical high energy railgun. The high current density required by railguns causes extreme wear on the rail and barrel, and as a result, practical railguns can achieve projectile velocities of no more than about 2.5 km/s. Railguns that do reach greater velocities are typically single-shot, or nearly single-shot.

In a railgun, the accelerating magnetic field is produced by what is essentially a single-turn coil. Generating the required high magnetic-flux density using such a coil requires an extremely high current density, combined with a relatively low voltage. However, concerns over the maximum current carrying capacity of the conductors typically limit a railgun's magnetic flux density to approximately 5 Tesla, which in turn limits a railgun's accelerating force.

Railguns use an arc of plasma to make the electrical contact between the projectile and the rails. Therefore, it is essential that this plasma arc accelerates at the same rate as the projectile. However, with existing railgun technology, it is not possible to control the plasma arc in a repeatable manner when operating at very high velocities and power densities. As a result, the plasma arc typically either lags behind the projectile, or passes it, further limiting the efficiency and maximum velocity that a railgun can attain.

In a coilgun, also known as a "mass driver", or "co-axial accelerator", a projectile is made to pass through a series of electromagnetic coils, or solenoids. These solenoids are precisely controlled to turn on, or become magnetic, as the projectile is approaching, and to turn off the instant the projectile passes, allowing the projectile to be pulled forward by the next solenoid in the series.

The magnetic pressure that is applied to an object by a solenoid decreases with the square of the distance between the object and the solenoid's center. Therefore, to get the maximum efficiency out of a coilgun, the projectile must be allowed to approach as closely as possible to the center of each soil (solenoid) before the coil is turned off. However, if the projectile is allowed to pass through the center of the coil before the coil is completely turned off, the magnetic force that was previously accelerating the projectile will now be pulling it back, causing the projectile to slightly decelerate. As the ultimate velocity of the projectile increases, the turn-off time of each coil must decrease for the efficiency of the accelerator to be maintained. However, it is a fundamental characteristic of magnetic coils to create self-generated magnetic fields, which act to keep the coils partially energized (and thus partially magnetized) even when there is no current flowing to them. This characteristic of magnetic coils makes it very difficult to turn them off quickly enough. As a result, the efficiency of the coilgun decreases rapidly with increasing projectile velocity, and coilguns that operate at practical energy density levels are even more limited in their velocity than railguns.

In a conventional (explosive) gun, expanding gas from a chemical explosion pressurized the inside of a barrel behind the projectile. Because the projectile forms a sliding seal between itself and the barrel, it is accelerated by the pressurized gas behind it.

Due to gas dynamics limitations, a chemical-explosive gun cannot accelerate a projectile to a velocity that exceeds the blastwave velocity of the explosive being used. The highest blastwave velocity attainable with a chemical explosive is 2 km/sec. Therefore, even if provided with an infinitely long barrel, a conventional gun cannot accelerate a projectile beyond 2 km/s. Furthermore, the tremendous amounts of ammunition that would be required to operate a conventional gun for extended periods at high rates of fire would make it highly impractical for applications involving continuous operation, such as cutting or drilling.

A light gas gun uses a chemical explosive to produce the energy used to accelerate the projectile. However, a light gas gun circumvents the blastwave velocity limitations of a conventional gun by using its explosive to first accelerate a specific volume of low density gas, or "light gas", such as hydrogen, which is held in a series of stages behind the projectile. Upon discharge, a sliding piston, driven by the expanding gas from the conventional explosion, compresses the lower density gas in front of it, creating a second blastwave. However, unlike the relatively massive byproducts that make up the conventional explosive's blastwave, the lower mass of the "light" gas allows it to be driven to a much higher velocity by the same amount of energy. As a result, projectiles fired from light gas guns can reach velocities of 8 km/s or more.

Each shot of a light gas gun requires extensive manual preparation. For example, they typically use an exploding metal valve between each stage, which must be replaced after each shot, making continuous firing impractical. Furthermore, because barrel length and piston mass increase rapidly with projectile mass and velocity, light gas guns do not scale well to larger sizes. This characteristic limits the use of light gas guns to highly specialized research applications, within controlled laboratory environments.

SUMMARY OF THE INVENTION

The inventor of the present invention has recognized these and other problems associated with conventional accelerating devices, and has developed a cost-effective and energy efficient device for accelerating (and decelerating) an object are extremely high speeds.

In one embodiment of the invention, a helical field accelerator comprises one or more rotating members having outer surfaces in close proximity of each other; and a conduit disposed on the outer surface of one of the rotating members in the form of a helix, the conduit having a fluid disposed therein, wherein the conduit is influenced by the other one of the rotating members to transmit rotational kinetic energy of the one or more rotating members to a projectile disposed within the conduit, thereby converting rotational kinetic energy of the rotating members to linear kinetic energy of the projectile.

In another embodiment of the invention, a device comprises a first magnetic structure in close proximity to a second magnetic structure that produces a localized magnetic field having a variable pitch, wherein rotational kinetic energy of the magnetic structures is converted into linear kinetic energy in an object.

In yet another embodiment of the invention, an accelerator for accelerating an object comprises a plurality of structures, one of said plurality of structures comprising at least one rotating structure that interacts with another one of said plurality of structures to produce a helical field upon an object to cause the object to accelerate along said plurality of structures.

DESCRIPTION OF THE PREFERRED EMBODIMENT

Figure 1:
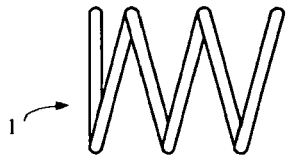
FIG. 1 shows a plan view of a structure for producing a localized pressure field is arranged in a helical, or spiral, pattern having a constant pitch.

The principles of the invention will now be described. In general, a helically configured structure 1, or an array of structures capable of producing a localized pressure field is arranged in a helical, or spiral, pattern, is shown in FIG. 1. A helically configured structure 2, in which the pitch of this helix, or the distance that a point on the helix will advance in one rotation, is made to vary from relatively low at its beginning, to relatively high at its end, is shown in FIG. 2.

Figure 2:
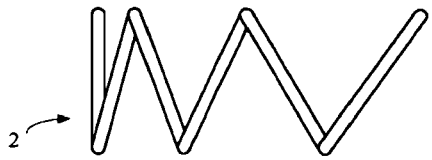
FIG. 2 shows a plan view of a structure for producing a localized pressure field is arranged in a helical, or spiral, pattern having a variable pitch.
Figure 3:
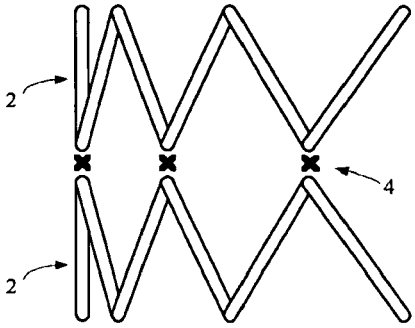
FIG. 3 shows a plan view of the structure of FIG. 2 mounted in proximity to one or more similar structures.
Figure 4:
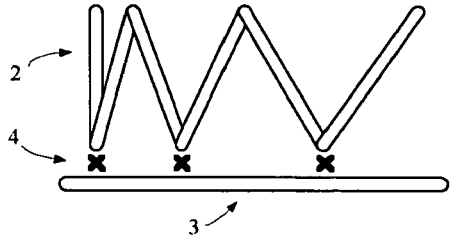
FIG. 4 shows a plan view of the structure of FIG. 2 mounted in proximity to one or more linearly arranged structures.

Referring now to FIG. 2, when one such helically configured structure 2 is mounted in proximity to one or more similar structures 2, or alternatively, when one such helically configured structure 2 is mounted in proximity to one or more linearly arranged structures 3 (FIG. 4), regions of high pressure are formed at the point or points 4 (designated by the 'X') where the structures 2 are nearest each other.

Figure 5A:
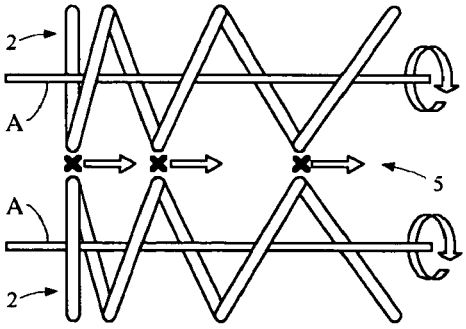
FIG. 5*a* shows a plan view of the structure of FIG. 3 mounted in proximity to one or more similar structures when both structures are rotating in the same direction.
Figure 5B:
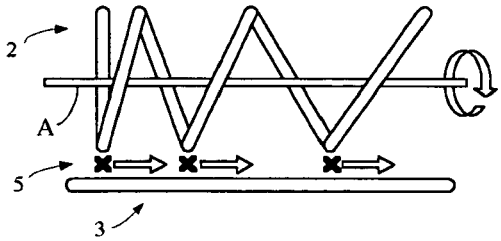
FIG. 5*b* shows a plan view of the structure of FIG. 4 mounted in proximity to one or more linearly arranged structures when one of the structures is rotating.

When the helically configured structure or structures 2 are made to rotate relative to each other (indicated by the arrows in FIG. 5*a*), the regions of high pressure travel along the structures 2 in a direction substantially parallel to the axes of rotation, A, effectively forming a series of traveling pressure waves 5. Similarly, when the helically configured structure 2 is made to rotate relative to linearly arranged structure 3 (indicated by the arrow in FIG. 5*b*), the regions of high pressure travel along the structures 2, 3 in a direction substantially parallel to the axes of rotation, A, effectively forming a series of traveling pressure waves 5.

The pressure waves travel down the structures 2, 3 at a rate that is related to the pitch of the helix at any particular point. In a region of the helix where the pitch is lower than 1:1, or less than 45°, the speed of the traveling pressure wave will be some fraction of the rotational surface-speed of that point on the helix. In a region of the helix where the pitch is higher that 1:1, or greater than 45°, the speed of the traveling wave will be some multiple of the rotational surface-speed of that point on the helix. Thus, assuming a constant speed of rotation, in a region of low helix pitch, the pressure wave moves slowly; in a region of high pitch, the pressure wave travels more rapidly.

Because the pitch of the helix varies from relatively low at its beginning, to relatively high at its end, the resulting pressure waves travel relatively slowly at the beginning of the helix and progress down it at an ever increasing rate. When the final pitch ratio of the helix is very high, for example 50:1, extremely high pressure-wave velocities can be produced using relatively moderate rotational speeds.

When a pressure-responsive object is placed in or near one of these traveling pressure waves 5, the object will be accelerated, or decelerated, depending on whether the pressure wave is traveling in the direction of increasing pitch, or decreasing pitch, along the helix.

In the case where the device is being used as an accelerator, this variation in the speed of the pressure waves allow the device to accelerate an object gradually, ensuring that the force holding it within the pressure wave is not exceeded. Furthermore, by matching the helix pitch and helix rotation speed to the mass of the object, the pressure wave can be made to accelerate the object at the highest rate that object's inertia will allow. This direct control that the device allows over the velocity of the pressure wave makes it possible to precisely match the acceleration rate of the pressure wave to the maximum possible acceleration rate of the object, ensuring that the pressure wave does not leave the object behind.

The above acceleration mechanism can employ a variety of pressure fields, including contact and non-contact fields. Examples of contact pressure fields include fluid pressure against a surface, and the pressure created by the direct mechanical contact between one surface and another. Examples of non-contact pressure fields include magnetic fields, and electrostatic fields. For the sake of convenience, however, the following device configurations will all contact pressure fields to be from fluid pressure, and all non-contact pressure fields to be from magnetic pressure. Among those configurations that employ fluid pressure, a distinction will be made between compressible and non-compressible fluids.

A Fluid-Pressure Accelerator

In general, in a helical accelerator that employs fluid pressure, the rotational kinetic energy in the device is transmitted to the projectile through the medium of a fluid, such as water, or the like, which acts as a buffer between the rotating members of the device and the projectile. This buffer fluid may be either a compressible or non-compressible fluid.

Figure 6:
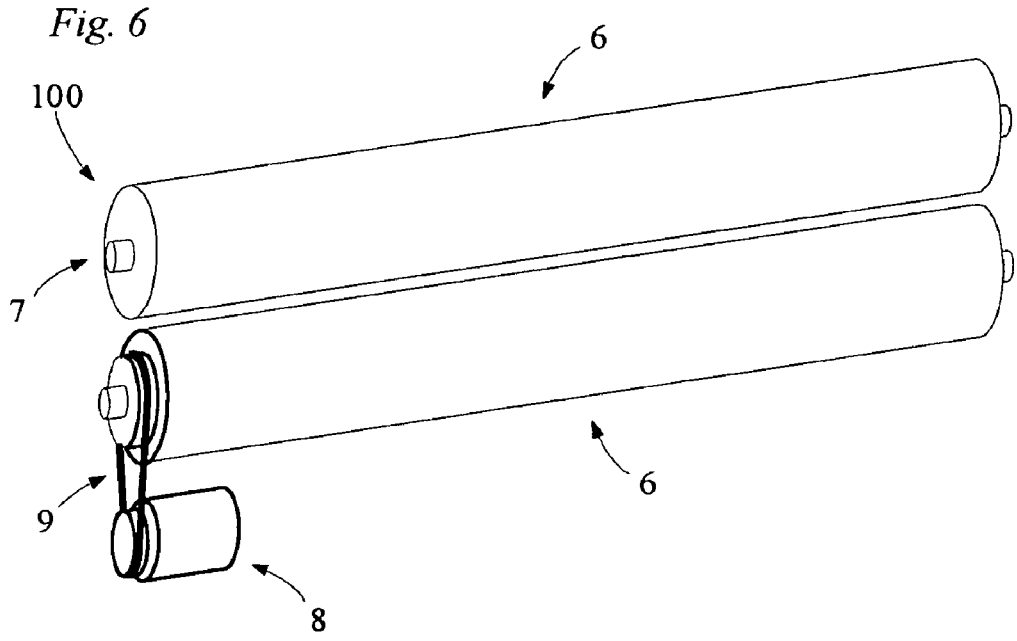
FIG. 6 shows a perspective view of a helical fluid-pressure accelerator in the form of two parallel, elongated cylinders.

Referring now to FIG. 6, a helical accelerator 100 can take the form of two parallel, elongated cylinders 6 mounted in close proximity to each other. The cylinders 6 rotate axially on bearings 7, and an engine or motor 8 is used to drive one or both of them either directly, or through a transmission 9. It will be appreciated that the invention is not limited by the type of rotating means, and that the invention can be practiced with any desirable means for rotating the cylinders 6.

Figure 7:
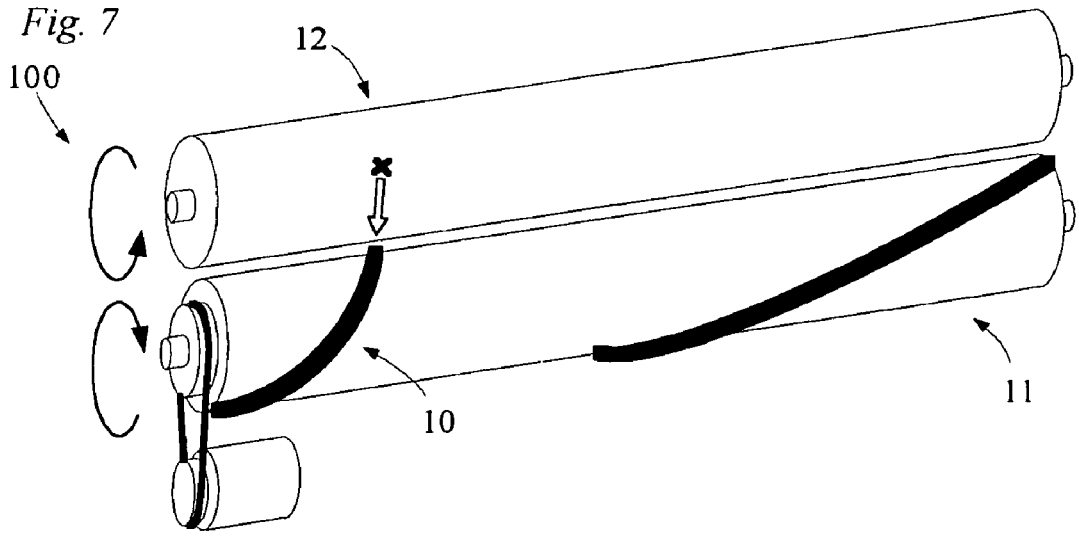
FIG. 7 shows a perspective view of the helical fluid-pressure accelerator of FIG. 6 with a conduit disposed on one of the cylinders.

Referring to FIG. 7, the helical accelerator 100 includes a conduit 10 having a cross-section of selectively reducible area and with a diameter significantly less than that of a driven cylinder 11, is arranged in a helical or spiral pattern around the circumference of one of the cylinders 11, 12. By definition, a conduit is a natural or artificial channel through which something, for example, a fluid, and the like, is conveyed. A conduit can be formed by an article of manufacture that is specifically designed for conveying a fluid, such as a hose, and the like. A conduit can also be formed two or more surfaces interacting with each other, such as, a channel formed by the space between an inside surface of an outer member and an outside surface of an inner member disposed within the outer member. For example, a conduit or channel can be formed between the space between a cylindrically-shaped inner member having a corkscrew-shaped raised surface on its outer surface and a cylindrically-shaped outer member having a relatively smooth inside surface. Other configurations for a conduit or channel are within the scope of the invention as is known to those skilled in the art. The helical pattern of the conduit 10 is such that its pitch, or the distance that a point on the helix will advance in one rotation, varies from relatively low at its beginning at one end, to relatively high at its other end. The diameter of the conduit 10, or its height above the surface of the cylinder 11, is such that when the conduit 10 is at the intersection point of the cylinders 11, 12, it is forcibly compressed or pinched, thereby closing the conduit 10 to the passage of fluid.

The cylinders 11, 12 are driven rotationally in the direction of advancing helix pitch with the starting point of the helix being the end with the lowest pitch, and the final point of the helix being the end with the highest pitch. During rotation, the intersection of these two cylinders 11, 12 with the conduit 10 creates a traveling pinch-point (indicated by the 'X'), which moves down the cylinders 11, 12 in the direction of increasing helical pitch.

When a controlled volume of fluid is introduced into the conduit 10 at the point of lowest pitch, this volume will be captured by and pushed ahead of this traveling pinch-point, thereby forcing the captured fluid to travel through the conduit at the same rate as this intersection point. Because the conduit 10 is arranged around the cylinder 11 in a helix of increasing pitch, the rate at which the pinch-point travels down the cylinder 11 increases accordingly, even though the rotation speed of the cylinders 11, 12 may be constant.

Figure 8:
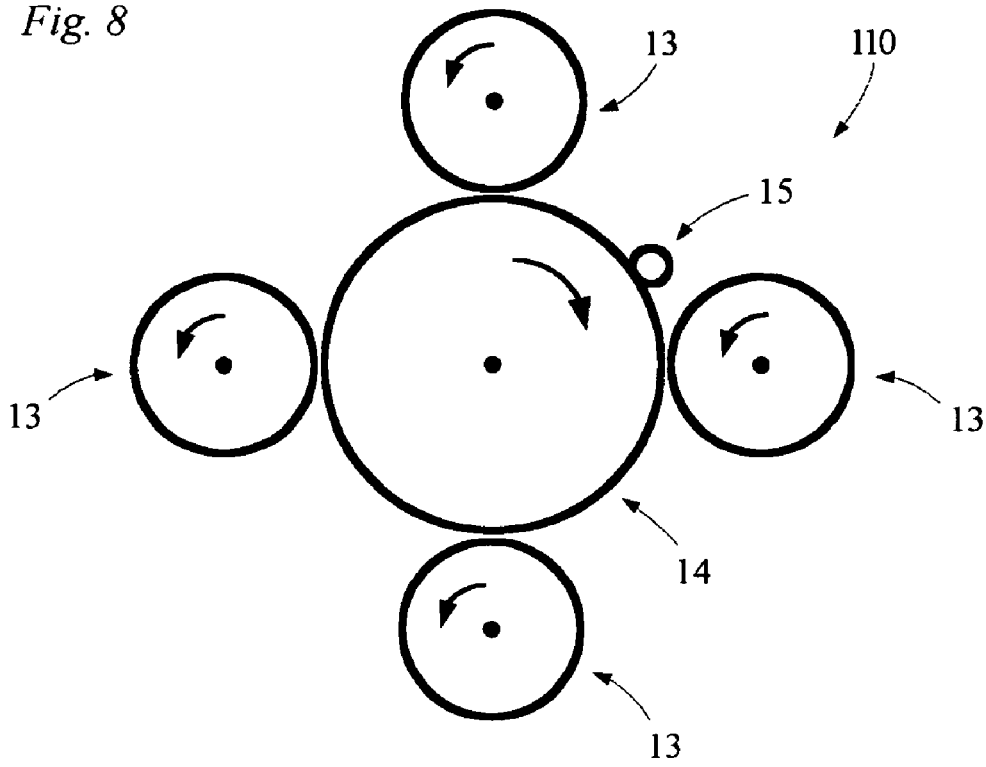
FIG. 8 shows an end view of alternate embodiment of the helical fluid-pressure accelerator of FIG. 6 having multiple cylinders rotating about a single cylinder.
Figure 9:
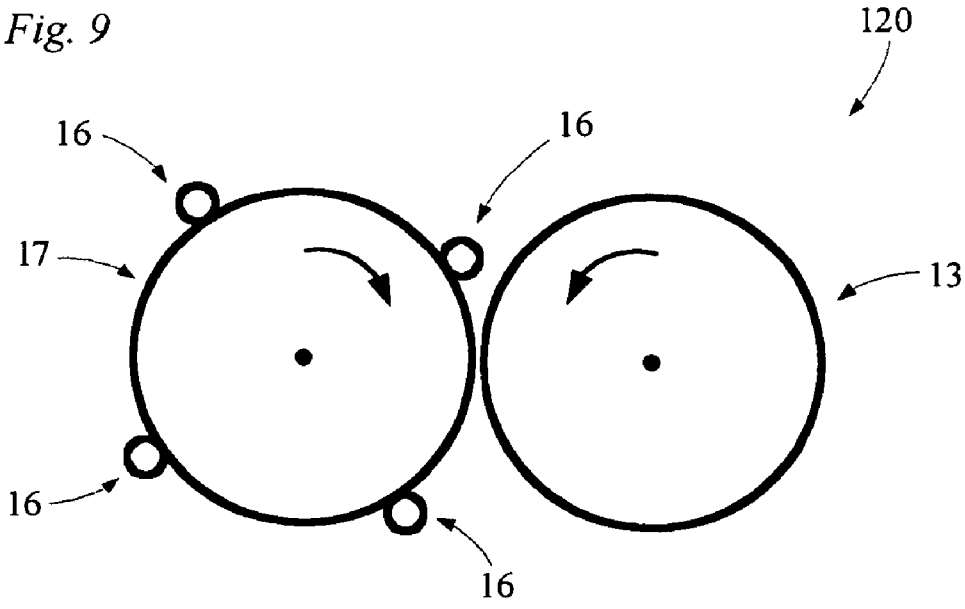
FIG. 9 shows an end view of another alternate embodiment of the helical fluid-pressure accelerator of FIG. 6 having multiple conduits on one cylinder.

Referring now to FIG. 8, in an alternative embodiment of a fluid-pressure accelerator 100, a fluid-pressure accelerator 110 increases the frequency of discharge by providing a plurality of cylinders 13 around a single cylinder 14 to which the conduit 15 is attached. As shown in FIG. 9, a similar effect can be achieved in another alternate embodiment of the fluid-pressure accelerator 100 by a fluid-pressure accelerator 120 that deploys a plurality of helical conduits 16 against a single cylinder 17. Both of these approaches have the effect of increasing the net volume of fluid accelerated without requiring an increase in the cylinder's rotation speed.

The fluid may either be drawn into the conduit 10 under its own pumping action, or the fluid may be forcibly injected. In the case where a compressible fluid, or gas, is used, it may be desirable to introduce the gas into the conduit with an initial pressure, in a pre-compressed state. By pre-compressing the gas in this way, the accelerator is able to devote more of its length to the actual acceleration of the gas, rather than having to first compress it before bringing to bear the full accelerating force. This pre-compression may be accomplished either through the use of a separate pumping stage, or through a chemical reaction during injection, such as a chemical explosion.

In the case where a non-compressible fluid is used as the buffer fluid, it may be desirable to introduce the fluid into the conduit 10 with an initial velocity. Because the helical conduit would not have to accelerate the fluid from a standing start, this would allow a higher cylinder rotation speed and a correspondingly higher fluid exit velocity.

Figure 10:
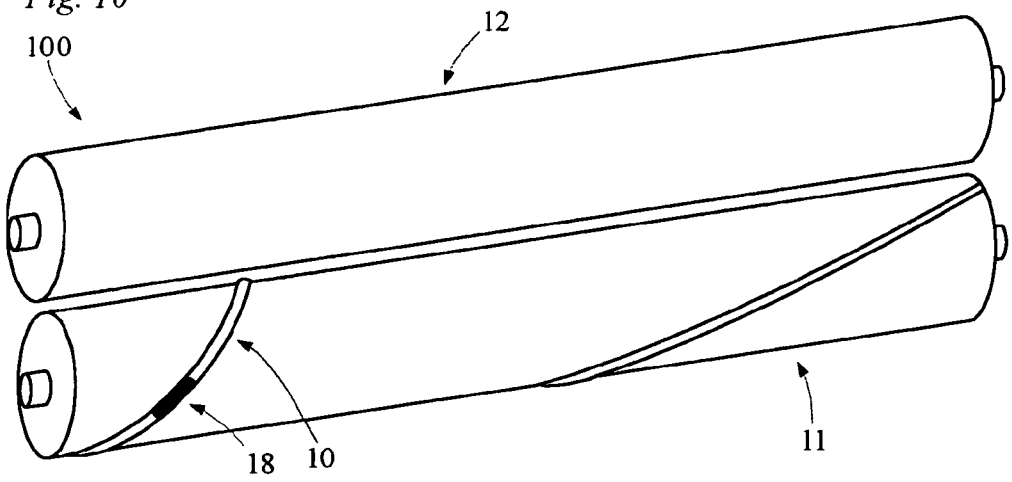
FIG. 10 shows a perspective view of the helical fluid-pressure accelerator of FIG. 6 with an alternate embodiment of the conduit disposed within a groove of one of the cylinders.

It should be noted that the friction between the fluid and the wall of the conduit 10 is proportional to surface area. It is therefore desirable to limit the volume of the buffer fluid in each uptake to only the amount needed to perform the work required by a particular application. As shown in FIG. 10, by limiting the length of each fluid element 18, it is possible to minimize the energy lost between the fluid and the walls of the conduit 10 to friction losses.

The resulting pulsed characteristic of its operation distinguishes the device 100 from a conventional pump, where the intent is typically to produce continuous flow. As a result of its pulsed operation, the helical accelerator 100 is not subject to cavitation, in which a fluid is forced to separate into both its liquid and gas states. In a conventional continuous-flow pump, fluid is both drawn or "pulled" into the pump on the intake side, and expelled or "pushed" through the output side. It is during the intake stage that cavitation can occur, where the dramatic acceleration of the fluid subjects it to such low pressure that it partially vaporizes. Due to the resulting gas in the fluid stream, the pump now must act on a fluid which is elastic in nature. This elasticity limits the force that can be exerted on the fluid during the time it is within the pump, and therefore limits the acceleration that the fluid can undergo. In contrast, in the helical accelerator 100 of the invention, the primary acceleration of the fluid occurs while the fluid is under compression on the "push" side of the pump, which therefore makes cavitation impossible. This allows the device 100 to exert an extremely high accelerating force on the fluid.

One aspect of the device 100 is that no sliding contact occurs between the cylinders 11, 12 and the conduit 10 during compression. As a result, wear on the conduit 10 is minimized.

Figure 11:
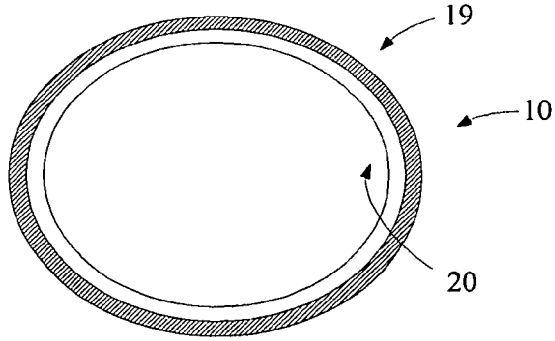
FIG. 11 shows a cross-sectional view of a conduit according to an embodiment of the invention.

In one embodiment of the invention shown in FIG. 11, the conduit 10 may consist of an outer layer 19 of flexible high-tension material 19, such as carbon fiber, Spectra fiber, or the like, and an inner lining 20 made from a flexible, heat resistant material, such as silicone, Teflon, or the like.

Figure 12:
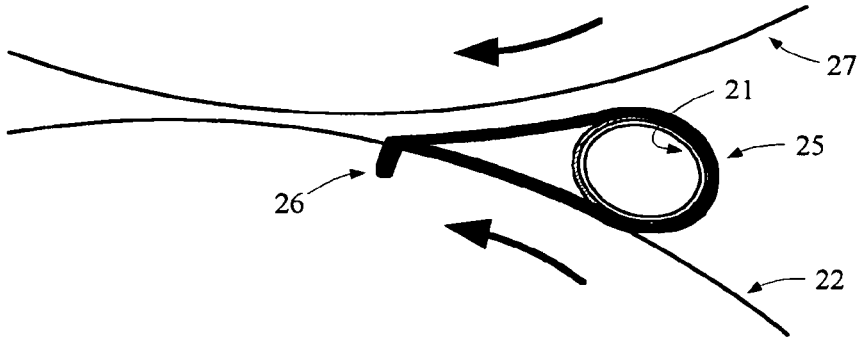
FIG. 12 shows a cross-sectional view of a method of attaching a conduit to one of the rotating cylinders according to the invention.
Figure 13:
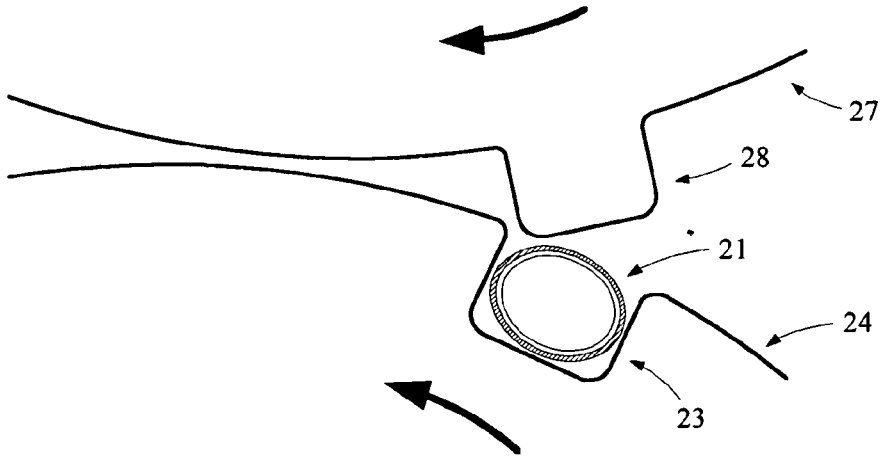
FIG. 13 shows a cross-sectional view of a method of disposing a conduit within a groove in one of the rotating cylinders according to the invention

Referring to FIG. 12, a conduit 21 may be either situated on the outside of a driven cylinder 22, or recessed within a helical grove or channel 23, as shown in FIG. 13 within a driven cylinder 24.

As shown in FIG. 12 where the conduit 21 is situated on the surface of the cylinder 22, the conduit 21 can be affixed to the cylinder 22 in such a way so as to resist the shear force interaction between the conduit 22 and the compressing cylinder 27. One method in which the conduit 21 can be affixed to the cylinder 22 as follows: The conduit 21 may be situated within a sling 25 of high tensile strength material, such as Kevlar, carbon fiber, Spectra fiber, or the like, so that the anchor point of the sling 26 is affixed to the driven cylinder 22 on the advancing side of the compressing roller 27. Other ways of affixing the conduit 21 to the surface of the driven cylinder 22 may exist, and would work equally well in the device 100.

As shown in FIG. 13 where the conduit 21 is recessed within a groove 23 in the driven cylinder 24, a raised feature 28 on the compressing cylinder 27 is synchronized to mesh within the groove 23, by a means well-known in the art, such as through a gear train, by contact between the raised feature 28 and the sides of the groove 23, or the like. Recessing the conduit 21 in this way allows the wall of the driven cylinder 24 to provide additional burst resistance to the conduit 21.

Figure 14:
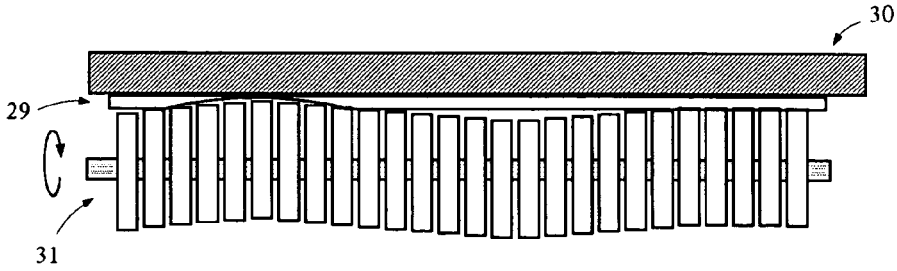
FIG. 14 shows a fluid-pressure accelerator with a plurality of rotating cams according to an alternate embodiment of the invention.

In an alternate configuration of a device 100' is shown in FIG. 14. In this configuration, the conduit 29 is fixed to a rigid linear member 30, and a segmented cylinder 31, which forms a continuous helical feature that is held against the conduit 29. This helical feature may be comprised of a series of eccentric, freely rotating lobes or cams 31, which sequentially come in contact with, and compress the conduit, thereby generating a traveling pinch-point. Because the conduit or channel can be formed by a space between two opposing surfaces, it is envisioned that the principles of the invention can be practiced by using an inner member having a helical feature, such as a raised peak, and the like, on its outer surface that is disposed within an outer member, such as a housing, and the like, having an inner surface opposing the outer surface of member. Such an arrangement is a three-dimension model of the principle of the invention shown in FIG. 14. In this three-dimensional model, the inner and outer members move relative to each other such that the helical feature generates a traveling pinch-point, thereby accelerating the fluid that is disposed within the conduit or channel formed by the inner and outer members. For example, the inner member may have an outer surface with a shape of a polygon, such as a Realeaux polygon, and the outer member may have an inside surface with a circular, an oblong, an oval shape, and the like. As in the other embodiments, the amount of acceleration can be selectively adjusted by varying the pitch of the helical feature. The pinch-point formed by the helical feature on the inner member interacting with the outer member may move linearly along the outer member as the inner and outer members move relative to each other. Alternatively, the pinch-point may move in a non-linear fashion, depending on the relative movement between the inner and outer member. It will be appreciated that the helical feature may be formed on the inside surface of the outer member, rather than on the inner member, and that the inner member may be relatively smooth, such as a cylinder, and the like.

Figure 15:
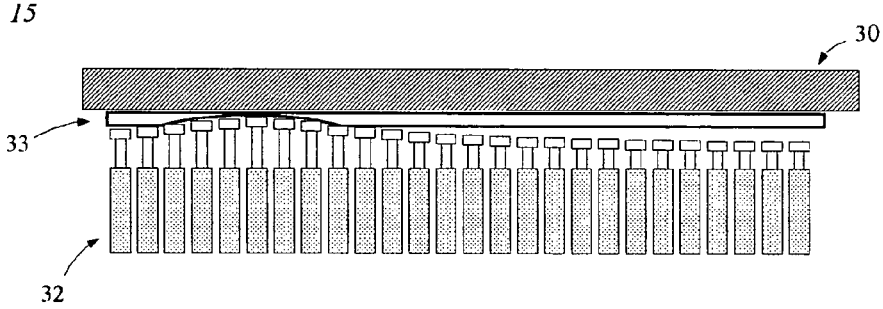
FIG. 15 shows a fluid-pressure accelerator with a plurality of rams according to yet another alternate embodiment of the invention.

Alternatively, this same effect may be achieved by the use of a series of pistons or rams 32 arranged linearly along the conduit 33, which are actuated in a controlled sequence to produce the effect of a virtual helix, as shown in FIG. 15.

These rams 32 may be powered by a chemical explosion, by hydraulic force, electrostatic force, magnetic force, or the like.

When a fluid pressure accelerator is used to directly accelerate an object traveling within the conduit, a rigid, non-elastomer conduit may be preferable, due to its ability to guide and stabilize the projectile within its walls.

Figure 16A:
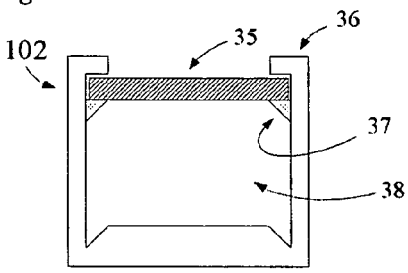
FIGS. 16*a* and 16*b* show a cross-sectional view of an alternative embodiment of a rigid conduit according to the invention in an open, unsealed position and a closed, sealed position.
Figure 16B:
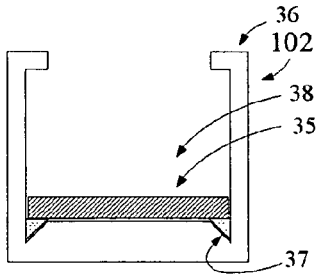

One such method of implementing a rigid conduit 102 with a reducible cross section is shown in FIG. 16*a* and FIG. 16*b*. A trough or channel 38 of rigid material, such a metal, or the like, is enclosed by a strip or roof 35 of flexible material. The strip 35 is made to be flexible along its longitudinal direction, while being inflexible across its span. The strip 35 is fitted into the trough 38 and retained by overhanging projections 36 to resist internal pressure. A sliding seal 37 exists between the sides of the strip 35 and the walls of the channel. The seal 37 may be created through close tolerances between the two members, or through the use of a separate seal. As shown in FIG. 16*a*, fluid is allowed to pass through the trough 34. However, when the roof 35 of the conduit 102 is compressed (FIG. 16*b*), the roof 35 slides to the bottom of the trough 34 and forms a seal with the floor of the trough 34, thereby preventing fluid to pass therethrough.

It may be appreciated that the invention can be practiced with other methods for producing a rigid conduit with a reducible cross section, and can be employed by the device 100 with no change to its essential principle of operation.

Modes for Accelerating a Projectile

There are several methods through which the above device 100 can use the energy from a high velocity fluid stream to accelerate a projectile. Four methods are given below.

Buffer fluid pushing a projectile ahead of it:

In this mode, a projectile is injected into the conduit 10 with the buffer fluid, and is pushed forward by the buffer fluid. Here, both the buffer fluid and the projectile are accelerated, but it is only the kinetic energy imparted to the projectile that is of interest.

Buffer fluid directed against a projectile:

In this mode, the buffer fluid is accelerated and then directed against the projectile, so that the kinetic energy of the fluid is imparted to the projectile through a momentum transfer.

Buffer fluid pressurizing an enclosed chamber:

Here, a compressible fluid is explosively injected into an enclosed chamber such as a gun barrel, thereby raising the pressure within the chamber and expelling a projectile contained within.

Buffer fluid as the projectile:

In this mode, the device 100 behaves strictly as a pump, and the buffer fluid itself serves as the projectile.

In all of the above operation modes, the rotation of the cylinders 11, 12 may be of a constant speed, or of a pulsed or intermittent nature. When the device 100 is used as a pump, as in the last configuration, a constant speed of rotation may be preferable. However, when the device 100 is used to accelerate an object, as in the first three modes given above, an intermittent rotation which allows energy to be injected into the device 100 in a single pulse may be preferred.

An Internal Combustion Engine

It is a fundamental principle of the device 100 that if rotation can cause compression, then expansion can cause rotation. This characteristic of the device 100 allows it to function as an internal combustion engine. By introducing a second cylinder or roller into the device 100, the conduit 10 may be closed in multiple locations simultaneously. This allows a gas and fuel mixture contained within it to be selectively compressed, ignited, and decompressed in a controlled sequence before exiting the device 100. In this configuration, the cylinders are self-powered, and a transmission is used to extract torque from the device 100. Unlike a reciprocating engine or a turbine engine, a helical internal combustion engine can operate efficiently at a very small scale due to its ability to provide arbitrarily long combustion cycles, regardless of the engine's scale. With reciprocating engines and turbine engines, the time available for combustion decreases as the engine's scale decreases.

A Magnetic-Pressure Accelerator

Figure 17A:
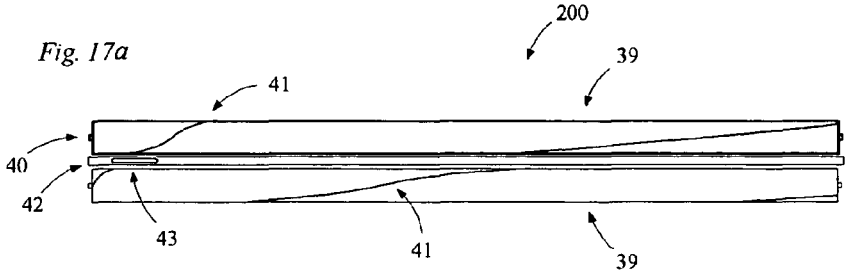
FIGS. 17*a* and 17*b* show a side view and a front view, respectively, of a magnetic-pressure accelerator having two rotating helical magnetic structures or cylinders according to an embodiment of the invention.
Figure 17B:
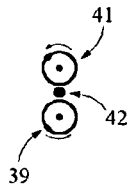

Referring now to FIGS. 17*a* and 17*b*, as with the fluid-pressure accelerator 100, a magnetic pressure accelerator 200 can take the form of two parallel, elongated cylinders 39 mounted in close proximity to each other. The cylinders 39 rotate axially on bearings 40, and an engine or motor (not shown) is used to drive one or both of them directly, or through a transmission.

A localized magnetic field 41 is generated at the surface of each cylinder 39 and is made to wrap around each cylinder 39 to form a helical or spiral pattern (helix). The pitch of this helix varies in a specific manner, from relatively low at its beginning at one end, to relatively high at its other end. When these cylinders are made to rotate in the same direction, the magnetic pressure wave that is produced by the convergence of their helical fields travels down the structures at a rate that is related to the pitch of the helixes at any particular point. In a region of low helix pitch, the pressure wave moves slowly; in a region of high pitch, the pressure wave travels more rapidly. Thus, given a fixed rotation speed, the magnetic pressure wave will move relatively slowly at the beginning of the helix and progress down it at an ever increasing rate.

Situated in the gap between the two cylinders 39 is a tube or similar containment structure 42 made of a rigid, magnetically transparent material, such as ceramic or the like. The structure 42 serves to guide and stabilize an object 43 being acted upon by the magnetic pressure wave. Alternatively, the helical magnetic cylinders 39 can be used by themselves to contain and stabilize the object 43, thereby making a separate guide unnecessary.

Figure 18:
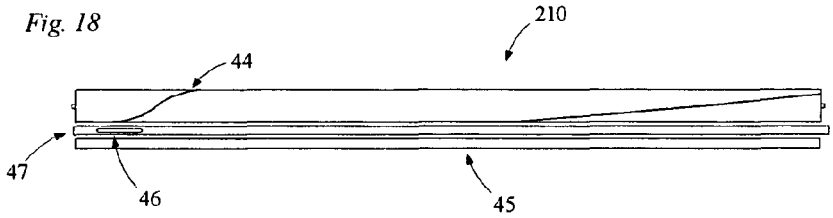
FIGS. 18*a* and 18*b* show a side view and a front view, respectively, of a magnetic-pressure accelerator having one rotating helical magnetic structure and one linear magnetic structure according to an alternate embodiment of the invention.
Figure 18B:
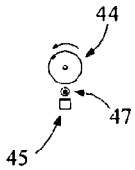

In another alternate configuration of the device 200, a device 210, shown in FIGS. 18*a* and 18*b*, includes a single rotating helical magnetic structure 44 mounted in proximity to a stationary, linear magnetic structure 45. The linear structure 45 acts as a track upon which an object 46 being accelerated is magnetically levitated to prevent mechanical contact. With this configuration, more than one linear structures 45 may be arranged around a single helical structure 44, allowing multiple objects to be accelerated simultaneously. As with the preceding configuration, a tube or similar containment structure 47 made from a magnetically transparent material is located between the helical structure 44 and the linear structure 45 to guide and stabilize the object 46 being acted upon. Alternatively, the linear and helical magnetic structures 44, 45 themselves may be used to contain and stabilize the object 46, making a separate guide unnecessary.

Figure 19:
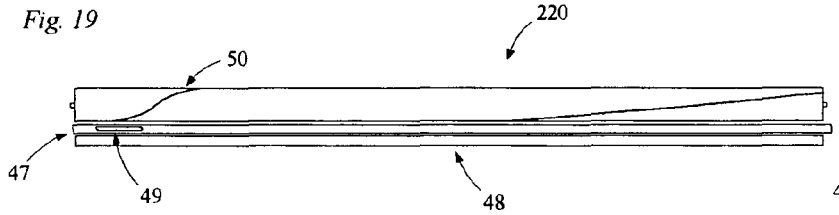
FIGS. 19*a* and 19*b* show a side view and a front view, respectively, of a magnetic-pressure accelerator having one rotating helical magnetic structure and two linear magnetic structures according to an another alternate embodiment of the invention.
Figure 19B:
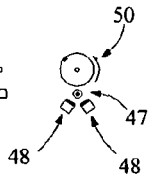

In a variation on the preceding configuration, a magnetic-pressure accelerator 220 includes two linear magnetic structures 48 may be used, rather than a one, effectively forming a magnetic "trough" for the projectile 49, as shown in FIGS. 19*a* and 19*b*. These two linear structures 48 are angled so that their magnetic pressure counteracts the side-forces that are exerted on a projectile 49 by a helical magnet 50, so that only the axial, or forward component of the force remains.

Figure 20:
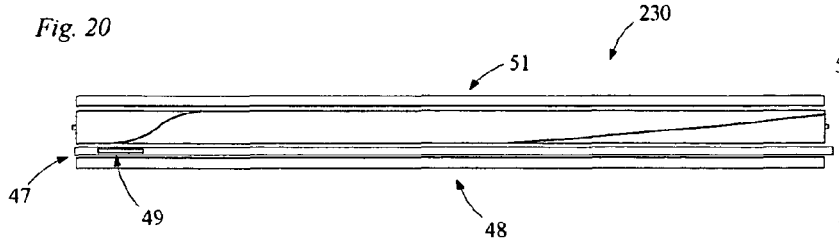
FIGS. 20*a* and 20*b* show a side view and a front view, respectively, of a magnetic-pressure accelerator having one rotating helical magnetic structure and three linear magnetic structures according to yet another alternate embodiment of the invention.
Figure 20B:
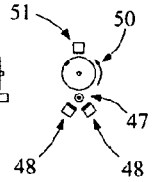

As a further modification to the device 200, a magnetic-pressure acceleration 230 includes a third linear magnetic structure 51 is mounted on the opposite side of the helix to balance the side forces that are imposed on the helical structure by the lower magnetic structures, as shown in FIGS. 20*a* and 20*b*. Using this arrangement, side forces on the helix are greatly reduced, allowing for a lighter and less rigid helical structure.

As with the previous configuration, this configuration allows several magnetic structures 48, 51 to be arranged around a single rotating helix 50, making it possible to accelerate multiple objects simultaneously. When this is the case, the side forces on the helix can be balanced by arranging these magnetic structures symmetrically around the helix, thereby making it unnecessary to use a separate magnetic structure specifically for this purpose.

Figure 21A:
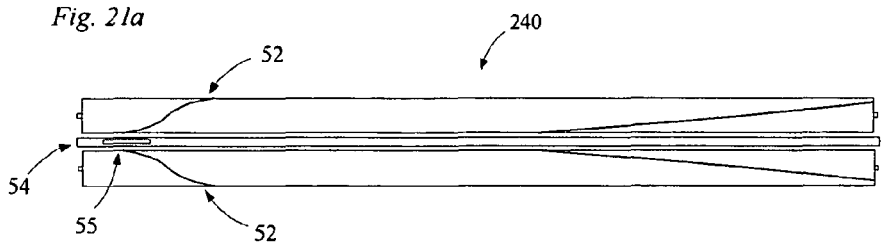
FIGS. 21*a* and 21*b* show a side view and a front view, respectively, of a magnetic-pressure accelerator having two rotating helical magnetic structures and one linear magnetic structure according to still yet another alternate embodiment of the invention.
Figure 21B:
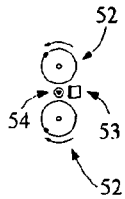

Elements of the preceding configurations may be combined to form yet another configuration of a magnetic-pressure accelerator 240, as shown in FIGS. 21*a* and 21*b*. In this arrangement, two helical magnetic structures 52 rotate in opposite directions, and a linear magnetic structure 53 is placed to one side of an object 54 being accelerated. As in the preceding configurations, this may function with or without the structure 53 to guide and stabilize the object 54.

Figure 22A:
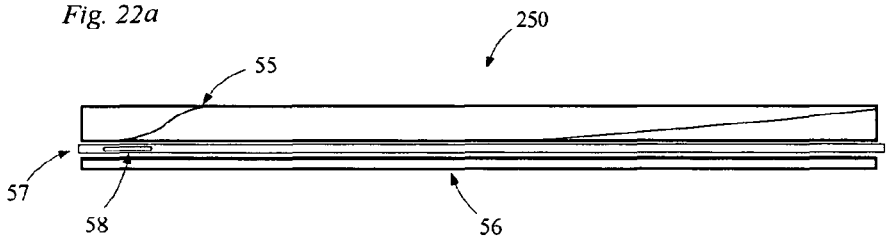
FIGS. 22*a* and 22*b* show a side view and a front view, respectively, of a magnetic-pressure accelerator having one rotating helical magnetic structure and a rotating linear magnetic structure according to still yet another alternate embodiment of the invention.
Figure 22B:
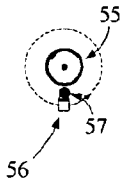

In yet another configuration of a magnetic-pressure accelerator 250, as shown in FIGS. 22*a* and 22*b*, one or more linear magnetic structures 56 revolve around a single, stationary helical magnetic structure 55. A containment structure 57, in this case one that revolves with one of the linear magnetic structures 56 (as indicated by the dashed lines in FIG. 22*b*), guides and stabilizes an object 58 being accelerated. Alternatively, the linear and helical magnetic structures 55, 56 themselves can be used to contain and stabilize the object 58, making a separate guide unnecessary.

Figure 23A:
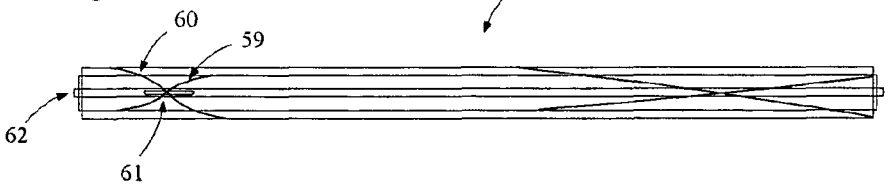
FIGS. 23*a* and 23*b* show a side view and a front view, respectively, of a magnetic-pressure accelerator having two concentric rotating helical magnetic structures according to still yet another alternate embodiment of the invention.
Figure 23B:
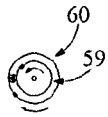

In still another possible configuration of a magnetic-pressure accelerator 260, as shown in FIGS. 23*a* and 23*b*, one helical magnetic structure 59 is mounted concentrically within another helical magnetic 60 structure, and the two structures 59, 60 are driven in opposite directions relative to each other. Other iterations of this same configuration include a stationary inner structure with a revolving outer structure, and a stationary outer structure with a rotating inner structure. As with the preceding configurations, the object being accelerated 61 can be guided by a magnetically transparent tube 62 or similar containment structure located between the two magnetic structures. Alternatively, the magnetic structures 59, 60 themselves can be used to contain and stabilize the object, making a separate guide unnecessary.

Figure 24A:
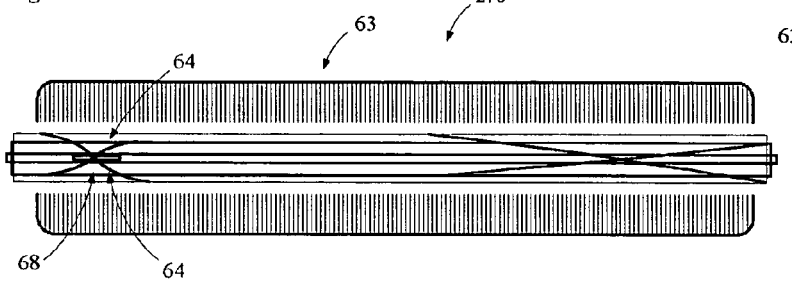
FIGS. 24*a* and 24*b* show a side view and an end view, respectively, of a magnetic-pressure accelerator having two concentric rotating helical magnetic structures surrounded by a magnetic field according to yet another alternate embodiment of the invention.
Figure 24B:
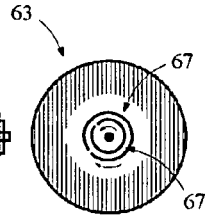

In a variation on the preceding configuration, a magnetic-pressure accelerator 270 is shown in FIGS. 24*a* and 24*b*. In this configuration, the accelerator 270 is surrounded by a strong magnetic field 63. In place of helical magnetic structures as in the previous embodiments, the cylinders 67 bear a magnetically shielding material, such as a super-conductive metal alloy or metal. Helical slots or perforations 64 through the shielding allow the ambient magnetic field 63 to pass through to the axis of the cylinders 67 at points corresponding to the slots 64 in the shields. When the cylinders 67 are made to rotate in opposite directions, these points of correspondence form regions of magnetic flux which move rapidly along the axis of the cylinders 67 along a traveling intersection between the slots 64 in the shields. A magnetically reactive object 68 placed at the axis of the cylinders 67 will therefore be accelerated along this traveling intersection.

Figure 25A:
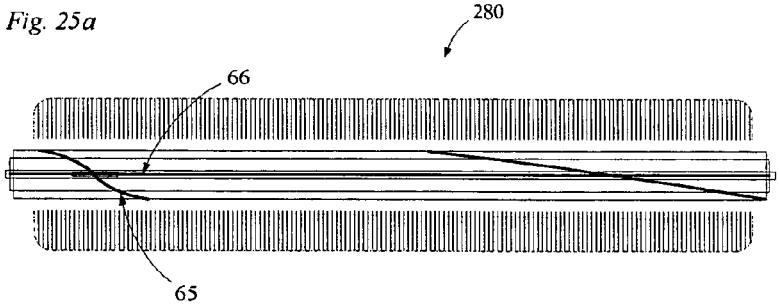
FIGS. 25*a* and 25*b* show a side view and an end view, respectively, of a magnetic-pressure accelerator having two concentric rotating helical magnetic structures surrounded by a magnetic field according to still yet another alternate embodiment of the invention.
Figure 25B:
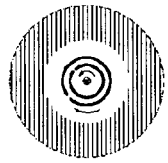

As with the other configurations, this traveling-intersection effect can be achieved through the use of a helical feature 65 and linear feature 66 in a magnetic-pressure accelerator 280 as shown in FIGS. 25*a* and 25*b*, rather than through two helical cylinders 67 shown in FIGS. 24*a* and 24*b*.

Some, but not all, possible configurations of a helical magnetic structure used in combination with other helical or linear structures are described. Instead, this description refers to any configuration in which a helically-patterned magnetic field interacts with a magnetically responsive object in such a way that relative rotational motion between them causes the object to be either accelerated or decelerated. Additionally, this device is not limited to magnetic structures that are arranged on a cylinder, but can employ any structure which generates a helically-patterned magnetic field at the point of interaction with a magnetically responsive object, regardless of how the field is produced. For example, this device does not require the helical magnetic pattern to be geometrically continuous, but rather the pattern may be comprised of an array of multiple, discrete magnetic sources, such that the net effect upon the object is that of a helix.

Performance Parameters

The device of the invention has multiple applications, spanning a diverse range of fields, and each of these applications has its own optimal projectile characteristics. These characteristics primarily involve projectile mass, projectile velocity, and rate of fire.

Projectile mass and projectile velocity are determined by specific physical characteristics of the device itself, such as the helix surface speed (the speed at which every point on surface of the helix is traveling axially), the final helix pitch (the distance that a point on the helix advances during one rotation), and the length of the helix (the accelerating distance available). Other characteristics include the pressure field strength, or 'flux density', at the point of interaction with the projectile, and the size of the power source used to rotate the helix or other components.

As a result, the basic physical parameters of the accelerator can vary widely depending on its application. Indeed, one of the principle benefits of this device is its ability to be scaled up or down to virtually any power level.

Although specific requirements for each application will be addressed separately, they all share a general range of performance criteria, which allows for a generalized version of the device to be described in the following terms:

Projectile velocity: Most of the applications for this device require a projectile velocity in excess of 3 Km/sec, with some requiring velocities of up to 150 Km/sec or more. For comparison, the velocity of a typical rifle round is approximately 1 Km/sec, and the velocity of a satellite in low earth orbit is approximately 7 Km/sec. Materials research has demonstrated that a 'universal damage criteria' exists at an energy density of 10,000 Joules/cm$^2$, and a projectile that is able to impart a net energy of 12,000 Joules to its target will vaporize one cubic centimeter of virtually any known material upon impact. Since many of the device's intended applications call for a complete removal of the target material, this velocity is used as a minimum benchmark for many of the projected versions.

Projectile mass: For most applications, the projectile will be traveling through air (as opposed to vacuum) during all, or part, of its flight. This requires that the projectile have a certain minimum mass to maintain its velocity through the air over the required distance. Therefore projectile mass ranges from milligrams for short range, low energy applications, to hundreds of kilograms or more for longer range and higher energy applications.

Surface speed: Due to the centrifugal forces involved, it is desirable to limit the surface speed of the helix and other rotating components to roughly 500 meters/sec (1.5 times the speed of sound) or less. However, it may be necessary to use higher surface speeds in certain applications.

Final helix pitch: Due to the above limitation on the surface speed of the rotating components, projectile velocity is largely determined by the final pitch of the helix. A helix pitch in the range of 7:1 (approximately 8°) is used in low velocity applications, and a pitch of up to 500:1 (approximately 0.11°) or greater is used in higher velocity applications.

Helix length: Since many applications require the device to be portable, a typical helix length might be in the range of 8 to 15 meters (25 to 50 ft). However, much shorter and much longer configurations can be produced for specific applications.

Magnetic flux density: The strength, or 'flux density', of the magnetic pressure wave determines the accelerating force that can be brought to bear on the projectile without the projectile breaking free from, and being left behind by, the traveling wave. For example, given a helix length of 8 meters, a flux density of 6.5 Tesla would be required to accelerate a 10 gram iron projectile to a velocity of 5,000 m/sec. This flux density is well within the range of existing resistive electromagnets and superconducting magnets.

Power source: Because this device uses rotational kinetic energy directly, without the need to first convert the energy into electrical form, it can be driven by a wide range of conventional power sources, including gas turbines, electric motors, and diesel engines. For example, a device that can accelerate a continuous stream of 10 g projectiles, at a rate of ten per second, to a velocity of 5,000 m/sec would require a power source of about 750 hp. A wide variety of power sources currently exist that are able to provide this level of output while still being suitably compact and inexpensive.

While the invention has been specifically described in connection with certain specific embodiments thereof, it is to be understood that this is by way of illustration and not of limitation, and the scope of the appended claims should be construed as broadly as the prior art will permit.

What is claimed is:

1. A helical field accelerator, comprising:

a pair of rotating members in close proximity of each other, one of the rotating members comprising a female rotating member having an outer surface that includes a groove in the form of a helix having a continuously increasing pitch, and the other one of the rotating members comprising a male rotating member having an outer surface that includes a raised feature adapted to be at least partially disposed within the groove; and a conduit at least partially disposed in the groove of the female rotating member, the conduit having a fluid disposed therein, wherein a traveling pinch-point is generated in the conduit by the interaction between the rotating members to transmit rotational kinetic energy of the rotating members to the fluid within the conduit, thereby converting rotational kinetic energy of the rotating members to linear kinetic energy of the fluid disposed within the conduit and wherein the fluid has a discharge velocity that exceeds a supersonic velocity of the fluid.

2. The helical field accelerator according to claim 1, further comprising a projectile disposed within the conduit, and wherein the fluid acts as a buffer between the rotating members and the projectile.

3. The helical field accelerator according to claim 1, wherein an acceleration of the fluid is directly proportional to the pitch of the helix.

4. The helical field accelerator according to claim 1, wherein the conduit comprises a collapsible conduit.

5. The helical field accelerator according to claim 1, wherein the conduit comprises a non-collapsible conduit.

6. An accelerator for accelerating a fluid comprising a female rotating structure and a male rotating structure, the female rotating structure having a groove, the male rotating structure having a raised feature that interacts with the groove of the female rotating structure to produce a helical field having a continuously increasing pitch upon a fluid disposed within the groove of the female rotating structure and cause the fluid to accelerate along the female and male rotating structures, wherein the acceleration of the fluid is directly proportional to the pitch of the helical field, and wherein the fluid has a discharge velocity that exceeds a supersonic velocity of the fluid.

7. The accelerator of claim 6, wherein one of the female and male rotating structures creates a pressure field for providing a medium for carrying an object.

8. The accelerator of claim 7, wherein the pressure field comprises a fluid-pressure field.

9. A helical field accelerator, comprising:

a pair of rotating members having outer surfaces in close proximity of each other, the outer surface of one of the rotating members including a groove, and the outer surface of the other one of the rotating members including a raised feature; and a conduit formed by a space between the outer surfaces of the rotating members in the form of a helix having a continuously increasing pitch, the conduit having a fluid disposed therein, wherein a traveling pinch-point is generated by the interaction between the groove and the raised feature, and wherein the pitch of the helix varies so that a velocity of the traveling pinch-point continuously increases as the pinch-point travels along a length of the rotating members, thereby accelerating the fluid within the conduit, wherein an acceleration of the fluid is directly proportional to the pitch of the helix, and wherein the fluid has a discharge velocity that exceeds a supersonic velocity of the fluid.

10. The helical field accelerator according to claim 9, wherein the fluid acts as a buffer between the rotating members and a projectile disposed within the fluid.

11. The helical field accelerator according to claim 9, wherein the conduit comprises a collapsible conduit.

12. The helical field accelerator according to claim 9, wherein the conduit comprises a non-collapsible conduit.

13. An accelerator, comprising:

a first member having an outer surface with a groove;

a second member having an outer surface with a raised feature in close proximity with the groove of the first member, wherein the groove forms a helical feature having a varying pitch; and a conduit formed by a space between the groove of the first member and the raised feature of the second member, the conduit having a fluid disposed therein, wherein a traveling pinch-point is generated by the interaction between the groove and the raised feature when the first and second members are moved relative to one another, and wherein the pitch of the helical feature varies such that a velocity of the traveling pinch-point continuously increases as the pinch-point travels along a length of the first and second members, thereby accelerating the fluid within the conduit when the first and second members are moved relative to one another such that the fluid has a discharge velocity that exceeds a supersonic velocity of the fluid.

14. The accelerator according to claim 13, wherein the fluid acts as a buffer between the first and second members and an object disposed within the fluid.

15. The accelerator according to claim 13, wherein an acceleration of the fluid is directly proportional to the varying pitch of the helical feature.

16. The accelerator according to claim 1, wherein a final pitch of the helix is in a range between 7:1 and 500:1.

17. The accelerator according to claim 6, wherein a final pitch of the helix is in a range between 7:1 and 500:1.

18. The accelerator according to claim 9, wherein a final pitch of the helix is in a range between 7:1 and 500:1.

19. The accelerator according to claim 13, wherein a final pitch of the helix is in a range between 7:1 and 500:1.

* * * * *